US005827205A

United States Patent [19]

Iwamoto

[11] Patent Number: 5,827,205

[45] Date of Patent: Oct. 27, 1998

[54] FOOT VIBRATOR MASSAGER HAVING A PAIR OF SOLINOIDS

[75] Inventor: Hironori Iwamoto, Sakata-gun, Japan

[73] Assignee: Matsushita Electric Works, Ltd., Osaka, Japan

[21] Appl. No.: 713,032

[22] Filed: Sep. 12, 1996

[30] Foreign Application Priority Data

Oct. 26, 1995 [JP] Japan ..... 7-279448

[51] Int. Cl.[6] ..... A61H 1/00; A61H 23/02

[52] U.S. Cl. ..... 601/78; 601/111; 601/28

[58] Field of Search ..... 601/21, 22, 28–30, 601/78, 107–111

[56] References Cited

U.S. PATENT DOCUMENTS

| | | | |
|---|---|---|---|
| 2,041,693 | 5/1936 | Boltz et al. | 601/28 |
| 2,265,729 | 12/1941 | Hall | 601/104 |
| 2,276,510 | 3/1942 | Newton | 601/22 X |
| 3,942,520 | 3/1976 | McNair | 601/78 X |
| 5,573,500 | 11/1996 | Katsunuma et al. | 601/111 |

FOREIGN PATENT DOCUMENTS

| | | | |
|---|---|---|---|
| 405285190 | 11/1993 | Japan | 601/22 |
| 7-7959 | 3/1995 | Japan . | |

*Primary Examiner*—Danton D. DeMille

*Attorney, Agent, or Firm*—Armstrong, Westerman, Hattori, McLeland & Naughton

[57] ABSTRACT

A foot massager having massaging applicators and capable of holding the feet of a user stably thereon to avoid an accidental actuation of a control section by the feet. A massager housing has an inclined top wall. The applicators are supported to the inclined top wall and are movable in a massage direction perpendicular to a general outer surface of the inclined top wall. Mounted within the housing are a pair of solenoids each having a plunger of which longitudinal axis is aligned with the massage direction. The plunger is connected at its upper end with the applicator and is attracted by repetitive energization of the solenoid to periodically move the applicator upward along the massage direction from a depressed position where the applicator is depressed by the foot of the user, thereby giving a tapping massage action to the foot. The control section is provided on a lower portion of the top wall adjacent to a front lower end of the housing and includes a switch for actuating the solenoid. The applicators are disposed in an upper portion of the inclined top wall adjacent to a rear upper end of the housing. Projected between the applicators and the control section is a heel stopper which bears the heels of the foot placed on the applicator. Thus, the heel stopper prevents the user's feet from slipping towards the control section and therefore protects the control section from being actuated by the user's heel during the massage.

16 Claims, 4 Drawing Sheets

FOOT VIBRATOR MASSAGER HAVING A PAIR OF SOLINOIDS

BACKGROUND OF THE INVENTION

1. Field of the Invention

The present invention is directed to a foot massager which is in use placed upon a floor to receive the feet of a user sitting on a chair to give a tapping massage to the feet with a pair of applicators which are connected to a plunger to thrust upward from a depressed position by repetitive energization of a solenoid disposed in a massager housing.

2. Description of the Prior Art

Japanese Utility Model Publication (KOKOKU) No. 7-7959 discloses a prior foot massager having a pair of applicators which are driven to reciprocate for applying a tapping massage to the feet of a user placed thereon and having a control section which includes a power switch for energizing the applicators. However, the control section is disposed in such an adjacent position to the applicators that the heel of the feet can readily reach the control section. Thus, there is always an error that the control section is accidentally actuated by the heels of the feet during the massage.

SUMMARY OF THE INVENTION

The present invention has been accomplished in view of the above problem and provides a foot massager which is capable of protecting the control section from being accidentally touched by the heel of a user enjoying a foot massage. The foot massager in accordance with the present invention comprises a housing formed with an inclined top wall extending from a front lower end to a rear upper end of the housing. A pair of applicators are provided to receive thereon the feet of the user and are supported to the inclined top wall so as to be movable in a massage direction perpendicular to a general outer surface of the inclined top wall. Mounted within the housing are a pair of solenoids each having a plunger of which longitudinal axis is aligned with the massage direction. The plunger is connected at its upper end with the applicator and is attracted by repetitive energization of the solenoid to periodically thrust the applicator upward along the massage direction from a depressed position where the applicator is depressed by the foot of the user, thereby giving a tapping massage action to the foot. A control section is provided on a lower portion of the inclined top wall adjacent to the front lower end of the housing and includes a switch for actuating the solenoid. The applicators are disposed in an upper portion of the inclined top wall adjacent to the rear upper end of the housing. Projected between the applicators and the control section is a heel stopper which bears the heels of the feet placed on the applicator. Thus, the heel stopper prevents the feet of the user from slipping towards the control section and therefore protect the control section from being accidentally actuated by the heels of the user during the use of the massager.

Preferably, a first concave is formed between the heel stopper and the upper portion of the top wall having the applicators in order to receive a portion of the heel and therefore hold the user's feet stably on the massager. Further, the control section is disposed in a second concave formed forwardly of the heel stopper so that the control section can be kept intact from the heel even when the foot is slipped down towards the front of the housing during the use.

The plunger is formed at its lower end with a flange which is engageable with an elastic stopper projecting on the lower end of the solenoid. The plunger has an initial position which is displaced upwardly from the depressed position and in which the flange is pressed against the elastic stopper. The applicator is movably supported to the inclined top wall and is given a self-bias to urge the applicator upwardly. The self-bias is transmitted to hold the plunger in the initial position when no load is applied to the applicator. Consequently, although an attracting force is applied to thrust the plunger upwards from the initial position when the massager is powered without the feet placed on the applicators, the plunger is allowed to move only for such a slight distance as to deform the elastic stopper or even not allowed to move by the stopper. Thus, the plunger is protected from moving upward from the initial position by a substantially large distance, which reduces mechanical noises when the massage is powered on under no load condition.

The plunger has inherently a lower dead point and the applicator is movable together with the plunger between the initial position and the depressed position where it is depressed by the foot of the user. It is made to retain the plunger upwardly of the lower dead point when the applicator comes to the depressed position. Thus, the tapping massage is obtained by the plunger periodically moving from the position upwardly of the lower dead point to the initial position, whereby the solenoid can effectively apply the attracting force to the plunger, i.e., the solenoid can generate a greater attracting force than moving the plunger from the lower dead point.

The applicator is formed around its periphery with an integral mount rim and an integral resilient joint disposed inwardly of the mount rim. The mount rim is fixed to the inclined top wall of the massager housing to support the applicator thereto, while the resilient joint permits the applicator to move relative to the top wall for a limited extent. The resilient joint has a generally U-shaped cross section with a pair of first flexible leg and a second flexible leg interconnected at their lower ends to form a round bent thereat. The first flexible leg blends at its upper end with the mount rim, while the second flexible leg blends at its upper end with the applicator through a restrictor of a thick member. It is these first and second flexible legs that are resiliently deformed to allow the relative movement of the applicator to the housing. The restrictor defines itself a rigid member which acts to inhibit the depression of the applicator beyond a point where the restrictor reaching the round bent. Accordingly, even when a heavy load is accidentally applied to the applicator, the restrictor formed as an integral part of the applicator can prevent the applicator itself from being depressed by an unduly large amount into the housing.

The longitudinal axis of the plunger is inclined at an angle of 17° to 30° with respect to a vertical line perpendicular to a supporting surface on which the foot massager is placed. With this inclined arrangement of the plunger, the user can enjoy the foot massage in a relaxed manner while sitting on a reclining chair with one's ankle kept at an unstrained optimum angle.

Further, the inclined top wall is rounded in a convex manner so as to well fit with the bottom of the feet and therefore stably hold the feet on the massager.

The solenoid is supported to the housing by means of a shock absorbing rubber which absorbs a counter-acting force applied back to the housing from the vibrating applicator, protecting the housing free from excess vibrations.

These and still other objects and advantages will become more apparent from the following detailed description of the embodiment when taken in conduction with the attached drawings.

DETAILED DESCRIPTION OF THE EMBODIMENT

Figure 1:
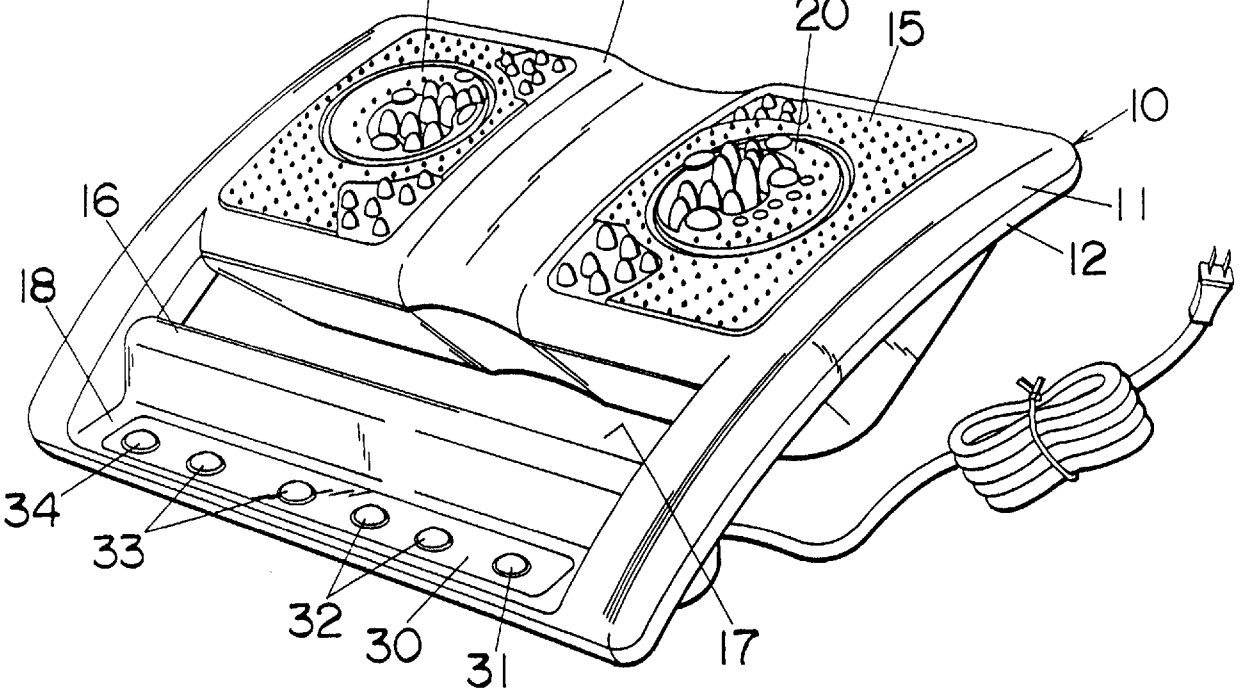
FIG. 1 is a perspective view of a foot massager in accordance with a preferred embodiment of the present invention.
Figure 2:
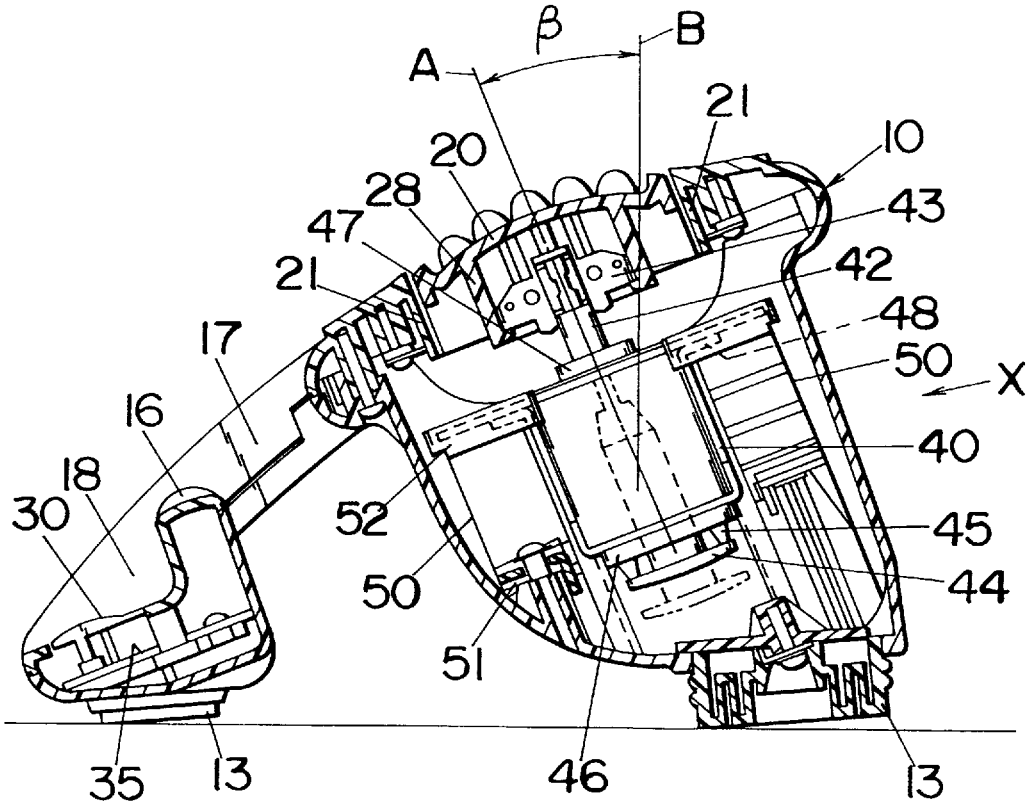
FIG. 2 is a vertical section of the massager.
Figure 3:
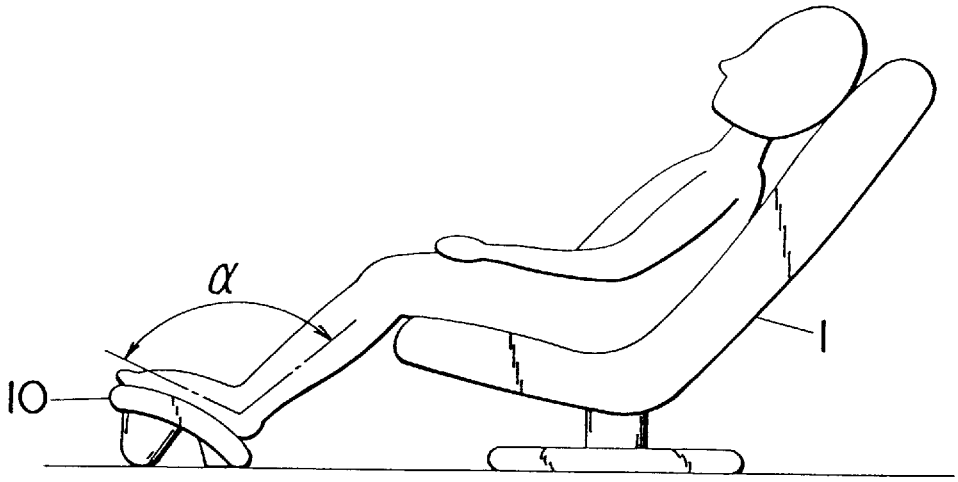
FIG. 3 is a schematic view illustrating the use of the massager.
Figure 4:
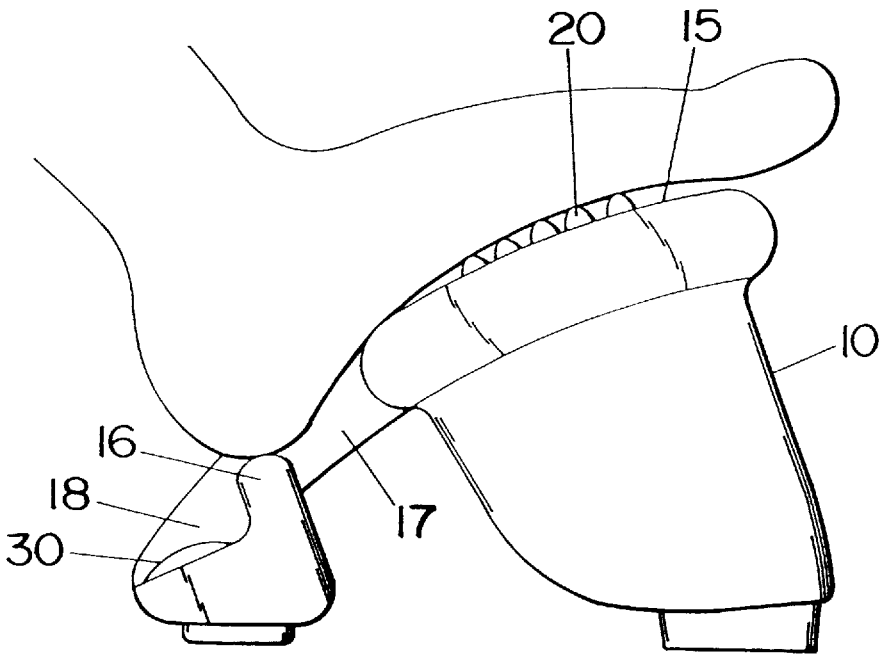
FIG. 4 is an enlarged schematic view illustrating the use of the massager.

The present invention will be now discussed with reference to the attached drawings. As shown in FIG. 3, a foot massager in accordance with the present invention is in use to be placed upon a floor to receive the feet of a user sitting on a chair 1, and comprises a pair of applicators 20 which are provided at the top of a housing 10 to vibrate for applying a tapping massage to the bottom of the feet. As shown in FIGS. 1 and 2, the housing 10 comprises a pair of upper housing member 11 and lower housing member 12. Rubber feet 13 are attached to the lower end of the housing 10. The upper housing member 11 has an inclined top wall 14 extending from a front lower end to a rear upper end of the housing and rounded convexly in conformity with an arch of the foot. The top wall 14 provides at its rear upper portion a foot support 15 in which the applicators 20 of generally rounded configuration are mounted. The applicator 20 is attached to the top wall by means of a resilient joint 21 to be movable along a direction substantially perpendicular to a general upper surface of the top wall. Relatively large projections are formed on the applicators 20 and on the foot support 15 to give stimulation to the arch of the feet, while small projections are formed on the rest of them to grip the feet on the massager.

Spaced forwardly of the feet support 15 having the applicators 20 there is formed a heel stopper 16 which project over substantially the entire width of the housing to receive the heels of the feet placed on the foot support 15, thereby preventing the feet from slipping down from the massager. Formed between the foot support 15 and the heel stopper 16 is a first concave 17 of a bottom open configuration for receiving therein a portion of the heel, thereby stably holding the feet on the massager. A second concave 18 is formed forwardly of the heel stopper 16 to locate therein a control section 30 of the massager so as to keep the control section 30 untouched even from the slipping heels.

Figure 6:
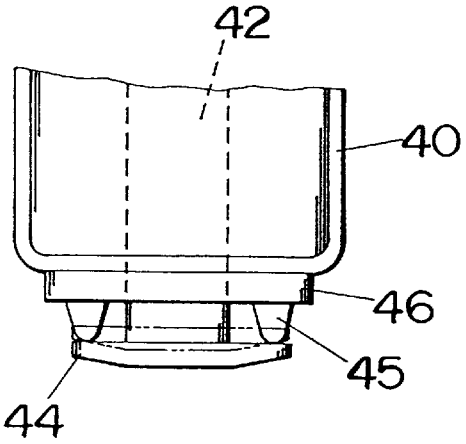
FIG. 6 illustrates a plunger of the massager in an initial position relative to an associated solenoid with an applicator attached thereto and with no load applied to the plunger.

Disposed inside of the housing 10 are a pair of solenoids 40 which are secured to the lower housing member 12 by means of shock absorbing rubber 50. A plunger 42 extends through a center opening of the solenoid 40 and is formed at its upper end with a coupler 43 for connection with a coupling ring 28 projecting on the lower center of the applicator 20. The solenoid 40 is connected to a power source and is controlled to be repetitively energized for cyclically generating an attracting force applied to the plunger 42, thereby vibrating the plunger 42 along its longitudinal axis, as described hereinafter. As shown in FIG. 2, the longitudinal axis A of the plunger 42 is aligned with a moving direction, i.e., the massaging direction of the applicator 20 and is inclined at an angle β of 17° to 30°, preferably 20°, relative to a vertical line B perpendicular to the floor. The plunger 42 is formed at its lower end with a flange 44 and has a substantial upper dead point where the flange 44 is pressed against elastic stoppers 45 projecting on the lower end of the solenoid 40 and a lower dead point where the joint 43 abuts against a member 47 at the upper end of the solenoid 40. In actual use where the feet are placed on the applicators 20 to apply a corresponding load thereto, the plunger 42 is lowered together with the applicator 20 to a depressed point which is spaced upwardly of the lower dead point. It is this depressed position at which the plunger 42 receives the repetitively attracting force, thereby giving the tapping massage to the bottom of the feet. As indicated by dotted lines in FIG. 6, the plunger 42 is given a bias by which it is pulled and held at the initial position where the flange 44 is pressed against the elastic stoppers 45. The bias comes from an inherent resiliency given to the applicator 20 as explained hereinafter.

The elastic stopper 45 are molded integrally with a rubber 46 secured to the bottom of the solenoid 40 and are slightly deformed by contact with the flange 44 as a result of that the plunger 42 is biased to the initial position to press the flange 44 against the elastic stoppers. Therefore, when the solenoid 40 is energized with the plunger 42 in its initial position to give the attracting force to the plunger 42, the plunger 42 is not allowed to move upward substantially away from the initial position due to the pressed contact of the flange 44 with the elastic stoppers 45. Even if there should an upward movement of the plunger 42, the plunger 42 is allowed to move only slightly with accompanied deformation of the elastic stoppers 45. Therefore, the upward movement of the plunger 42 is kept minimum to reduce noises or vibrations which would otherwise develop.

The control section 30 arranged on the bottom of the second recess 18 comprises a power switch 31, strength selection switches 32, speed adjusting switches 33, and an auto-mode selection switch 34 which are connected to the solenoid 40 through a control circuit 35 which gives a controlled energization of the solenoid 40 to adjust the strength and speed of the vibration of the applicator 20.

Figure 5:
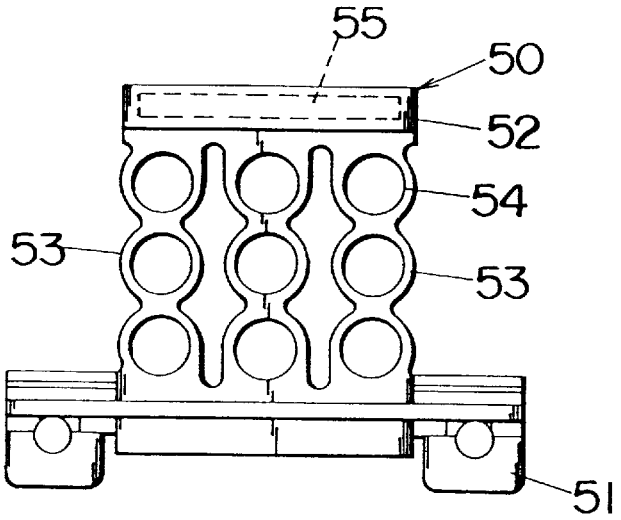
FIG. 5 illustrates a shock absorbing rubber utilized in the massager as viewed from X indicated in FIG. 2.

FIG. 5 illustrates the shock absorbing rubber 50 for floatingly supporting the solenoid 40 to the housing 10. The rubber 50 comprises a base 51 secured to the lower housing member 12 by screws, a catch 52 engaged with the solenoid 40, and three columns of resilient members 53 molded to integrally joining the base 51 and the catch 52. Each resilient member 53 comprises three aligned cylinders to give resilient deformability to the rubber in all directions. A brim 48 at the upper end of the solenoid 40 is engaged into a slot 55 of the catch 52 to hold the solenoid 40. With this floating support of the solenoid 40 by the shock absorbing rubber 50, it is made to attenuate or absorb a force applied to the solenoid as a counter action of applying the tapping massage action to the applicator 20, thereby reducing the resulting vibrations transmitted to the housing and the floor on which the massager is placed.

Figure 7:
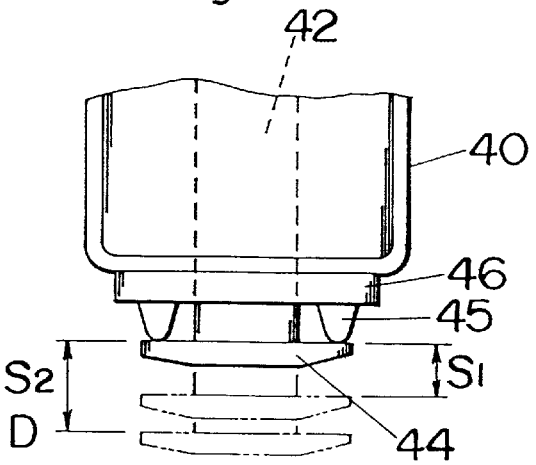
FIG. 7 illustrates a stroke given to the plunger from the initial position to a depressed position.
Figure 8A:
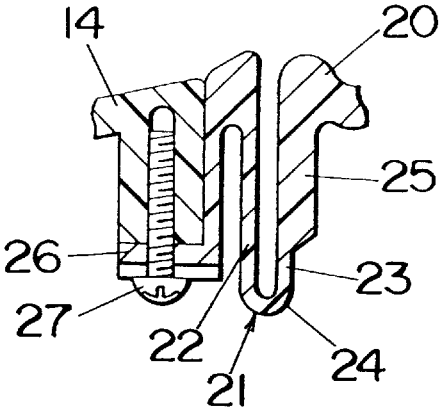
FIGS. 8A and 8B are sectional views illustrating a resilient joint formed around the applicator before and after it is deformed, respectively.
Figure 8B:
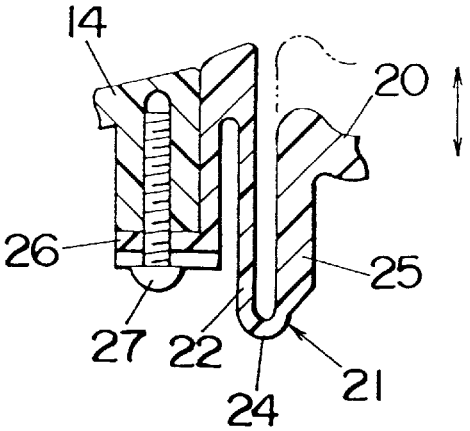

As shown in FIGS. 2, 8A and 8B, the applicator 20 is molded from a plastic material to integrally have a resilient joint 21 and an integral mount rim 26 therearound, and is fitted within a corresponding opening in the top wall 14 with the mount rim 26 fixed to the top wall by screws 27. The resilient joint 21 is of a generally U-shaped configuration with a pair of thin-wall first flexible leg 22 blending at its upper end with the mount rim 26 and thin-wall second flexible leg 23 blending at its upper end with the applicator 20. The first and second flexible legs 22 and 23 are interconnected at their lower ends to define thereat a rounded bent 24. The second flexible leg 23 is formed at its upper end with a thick-wall restrictor 25. Under no load condition, the applicator 20 is kept at the upper position, as shown in FIG. 8A. When the load is applied, the applicator 20 is depressed until the restrictor 25 reaches the bent 24, as shown in FIG. 8B. Thus, the applicator 20 is given a lowermost position where the restrictor 25 reaches the bent 24 and is prohibited from being depressed further. The resilient joint 21 gives the bias to return the applicator 20 towards the upper position of FIG. 8A and therefore urges the plunger 42 connected to the applicator 20 to the initial position where the flange 44 of the plunger 42 is pressed against the elastic stopper 45 of the solenoid 40, as shown in FIG. 7. Thus, in use when the feet of the user are placed on the applicators 20, the applicators 20 are depressed together with the associated plungers 42 to the depressed position from the initial position. Since the restrictor 25 limits the amount of downward displacement of the applicator 20, the plunger 42 is also made to have a limited downward displacement to the depressed point where the flange 44 is spaced from the elastic stopper 45 by a distance of Si, as shown in FIG. 7. The depressed position is set above the lower dead point of the plunger 42. That is, when connected to the applicator 20, the plunger 42 is made to have an effective reduced stroke Si which is smaller than a potential stroke S2 given to the applicator 20 itself from the common upper dead point. With this arrangement, the solenoid 40 can effectively apply the attraction force to the plunger 42 for giving a sufficient upward thrust from the depressed position upwardly of the lower dead point and therefore generating a sufficient tapping massage force by the upward movement of the plunger. Otherwise, or if the plunger should be depressed downward to a position D, as indicated in FIG. 7, only a less attraction force would apply to the plunger 42 thereby lowering the massaging force.

Further, since the restrictor 25 limits the downward displacement of the applicator 20 and the plunger 42, not only the shock absorbing rubber 50 can be protected from deforming largely but also the applicator 20 can be prevented from being tilted largely even if the load is concentrated to an off-center portion of the applicator, for example, the applicator is depressed unintentionally by the heel or the toe of the foot. That is, although the applicator 20 may tilt when subjected to such unintentional application of the load, the restrictor 25 formed around the applicator 20 can limit the amount of the tilting, thereby avoiding the applicator 20 and the associated moving parts from displacing largely to such an extent as to interfere with the housing 10 and therefore eliminates otherwise occurring noises.

Thus constructed foot massager is placed on the floor through the rubber feet 13 so that the user have the feet placed on the applicators 20 while sitting on the reclining chair 1 in a relaxed manner. In order to keep the ankle of the user at an optimum angle $\alpha$ for reducing a strain transmitted to the knee of the user sitting relaxed on the chair, a monitoring test was made to reveal that the longitudinal axis A of the plunger 42 should be inclined at an angle $\beta$ of 17° to 30°, most preferably 20° with respect to the vertical line B perpendicular to the floor.

What is claimed is:

1. A foot massager comprising:

a housing formed with an inclined top wall extending from a front lower end to a rear upper end of said housing;

a pair of applicators for receiving thereon feet of a user, said applicators being supported to said inclined top wall to be movable in a massage direction perpendicular to a general outer surface of said inclined top wall;

a pair of solenoids mounted within the housing, each solenoid having a plunger of which longitudinal axis is aligned with said massage direction, said plunger connected at an upper end thereof with said applicator and being attracted by repetitive energization of said solenoid to periodically move the applicator upward along said massage direction from a depressed position where said applicator is depressed by the foot of the user, thereby giving a tapping massage action to the foot, wherein said plunger includes means for reducing noises or vibrations thereof with said plunger impinging against elastic stoppers extending from each of said solenoids and wherein said means for reducing noises or vibrations includes a flange, formed at a lower end of said plunger, which is engageable with said elastic stopper projecting on the lower end of said solenoid; and a control section provided on a lower portion of said inclined top wall adjacent to said front lower end of said housing and having a switch for actuating said solenoid, wherein said applicators are disposed in an upper portion of said top wall adjacent to said rear upper end of said housing, and a heel stopper projects between said applicators and said control section to bear the heels of the user when the feet are placed on said applicators.

2. The foot massager as set forth in claim 1, wherein a first concave is formed between said heel stopper and said upper portion of said top wall provided with said applicators.

3. The foot massager as set forth in claim 2, wherein said control section is disposed in a second concave formed forwardly of said heel stopper.

4. The foot massager as set forth in claim 1, wherein said plunger having an initial position where said flange abuts against said elastic stopper, said initial position displaced upwardly from said depressed position, said applicator being movably supported to said inclined top wall and having a self-bias to urge the applicator upwardly, said self-bias being transmitted to hold said plunger in said initial position when no load is applied to the applicator.

5. The foot massager as set forth in claim 4, wherein said plunger has a lower dead point and said applicator is movable together with said plunger between said initial position and the depressed position where it is depressed by the foot of the user, the lower end of said plunger being retained upwardly of said lower dead point when said applicator comes to said depressed position, said lower dead point of said plunger being a member of an upper end of said solenoid abutting against a joint.

6. The foot massager as set forth in claim 5, wherein said applicator is formed around its periphery with an integral mount rim and an integral resilient joint disposed inwardly of said mount rim, said mount rim being fixed to said inclined top wall of the housing to support said applicator thereto, said resilient joint having a generally U-shaped cross section with a pair of first flexible leg and a second flexible leg interconnected at their lower ends to form a round bent thereat, said first flexible leg blending at its upper end with said mount rim, said second flexible leg blending at its upper end with said applicator through a restrictor of a thick member, said applicator being allowed to be depressed relative to said inclined top wall while resiliently deforming said first and second resilient legs;

said restrictor acting to inhibit the depression of the applicator beyond a point where said restrictor reaching said round bent.

7. The foot massager as set forth in claim 1, wherein the longitudinal axis of said plunger is inclined at an angle of 17° to 30° with respect to a vertical line perpendicular to a supporting surface on which said foot massager is placed.

8. The foot massager as set forth in claim 1, wherein said inclined top wall is rounded in a convex manner.

9. The foot massager as set forth in claim 1, wherein said solenoid is supported to said housing by means of a shock absorbing rubber.

10. A foot massager comprising:

a housing formed with an inclined top wall extending from a front lower end to a rear upper end of said housing;

a pair of applicators for receiving thereon feet of a user, said applicators being supported to said inclined top wall to be movable in a massage direction perpendicular to a general outer surface of said inclined top wall;

a pair of solenoids mounted within the housing, each solenoid having a plunger of which longitudinal axis is aligned with said massage direction, said plunger connected at an upper end thereof with said applicator and being attracted by repetitive energization of said solenoid to periodically move the applicator upward along said massage direction from a depressed position where said applicator is depressed by the foot of the user, thereby giving a tapping massage action to the foot, wherein said plunger includes means for reducing noises or vibrations thereof with said plunger impinging against elastic stoppers extending from each of said solenoids and wherein said means for reducing noises or vibrations includes a flange, formed at a lower end of said plunger, which is engageable with said elastic stopper projecting on the lower end of said solenoid; and a control section provided on a lower portion of said inclined top wall adjacent to said front lower end of said housing and having a switch for actuating said solenoid, wherein said applicators are disposed in an upper portion of said top wall adjacent to said rear upper end of said housing, a heel stopper projects between said applicators and said control section to bear the heels of the user when the feet are placed on said applicators, a first concave is formed between said heel stopper and said upper portion of said top wall provided with said applicators, and said inclined top wall is rounded in a convex manner so as to have an arcuately curved surface.

11. The foot massager as set forth in claim 10, wherein said control section is disposed in a second concave formed forwardly of said heel stopper.

12. The foot massager as set forth in claim 10, wherein said plunger having an initial position where said flange abuts against said elastic stopper, said initial position displaced upwardly from said depressed position, said applicator being movably supported to said inclined top wall and having a self-bias to urge the applicator upwardly, said self-bias being transmitted to hold said plunger in said initial position when no load is applied to the applicator.

13. The foot massager as set forth in claim 12, wherein said plunger has a lower dead point and said applicator is movable together with said plunger between said initial position and the depressed position where it is depressed by the foot of the user, the lower end of said plunger being retained upwardly of said lower dead point when said applicator comes to said depressed position, said lower dead point of said plunger being a member of an upper end of said solenoid abutting against a joint.

14. The foot massager as set forth in claim 13, wherein said applicator is formed around a periphery thereof with an integral mount rim and an integral resilient joint disposed inwardly of said mount rim, said mount rim being fixed to said inclined top wall of the housing to support said applicator thereto, said resilient joint having a generally U-shaped cross section with a pair of first flexible leg and a second flexible leg interconnected at lower ends thereof to form a round bent thereat, said first flexible leg blending at an upper end thereof with said mount rim, said second flexible leg blending at an upper end thereof with said applicator through a restrictor of a thick member, said applicator being allowed to be depressed relative to said inclined top wall while resiliently deforming said first and second resilient legs, said restrictor acting to inhibit the depression of the applicator beyond a point where said restrictor reaching said round bent.

15. The foot massager as set forth in claim 10, wherein the longitudinal axis of said plunger is inclined at an angle of 17° to 30° with respect to a vertical line perpendicular to a supporting surface on which said foot massager is placed.

16. The foot massager as set forth in claim 10, wherein said solenoid is supported to said housing by means of a shock absorbing rubber.

* * * * *